US006183620B1

(12) United States Patent
Verstreken

(10) Patent No.: US 6,183,620 B1
(45) Date of Patent: Feb. 6, 2001

(54) PROCESS FOR CONTROLLING THE $A1F_3$ CONTENT IN CRYOLITE MELTS

(75) Inventor: Paul Clement Verstreken, Hasselt (BE)

(73) Assignee: Heraeus Electro-Nite International N.V., Houthalen (BE)

( * ) Notice: Under 35 U.S.C. 154(b), the term of this patent shall be extended for 0 days.

(21) Appl. No.: 09/416,327

(22) Filed: Oct. 12, 1999

Related U.S. Application Data

(63) Continuation of application No. PCT/EP99/00846, filed on Feb. 10, 1999.

(30) Foreign Application Priority Data

Feb. 12, 1998 (DE) ..... 198 05 619

(51) Int. Cl.[7] ..... C25C 3/08
(52) U.S. Cl. ..... 205/336; 205/389
(58) Field of Search ..... 205/336, 389

(56) References Cited

U.S. PATENT DOCUMENTS 4,045,309 * 8/1977 Andersen ..... 205/336
4,668,350 * 5/1987 Desclaux et al. ..... 205/336
4,867,851 * 9/1989 Basquin et al. ..... 205/336
5,094,728 * 3/1992 Entner ..... 205/336

FOREIGN PATENT DOCUMENTS 0 195 142 A1 9/1986 (EP) .
0 455 590 A1 11/1991 (EP) .
0 703 026 A1 3/1996 (EP) .

* cited by examiner

*Primary Examiner*—Donald R. Valentine
(74) *Attorney, Agent, or Firm*—Akin, Gump, Strauss, Hauer & Feld, L.L.P.

(57) ABSTRACT

A process is provided for controlling the $AlF_3$ content in cryolite melts for aluminum reduction, wherein the temperature of the melt is measured. In order to produce a very precise process which makes it possible to perform the aluminum reduction at the lowest posssible temperature, and thus as energy-saving as possible, the liquidus temperature of the cryolite melt is measured and compared with a first target value. $AlF_3$ is added to the bath if the measured liquidus temperature is higher than the first target value. If the measured liquidus temperature is lower than the first target value, the measured liquidus temperature is compared with a second target value which is lower than the first target value. NaF or $Na_2CO_3$ is added to the bath if the measured liquidus temperature is lower than the second target value.

2 Claims, No Drawings

PROCESS FOR CONTROLLING THE A1$F_3$ CONTENT IN CRYOLITE MELTS

CROSS REFERENCE TO RELATED APPLICATION

This application-is a continuation of International Application PCT/EP99/00846 Filed Feb. 10, 1999.

BACKGROUND OF THE INVENTION

The invention relates to a process for controlling the $AlF_3$ content in cryolite melts for aluminum reduction, wherein the temperature of the melt is measured.

A process of this type is known from U.S. Pat. 4,668,350. In the process disclosed therein, a known relation between the bath temperature and the bath composition (NaF:$AlF_3$) is used. From this relation a target temperature of the bath is calculated as a function of a target composition (NaF:$AlF_3$). The temperature of the bath is measured and $AlF_3$ is added, if the bath temperature is higher than the target temperature. Of course, the bath temperature is also influenced by a series of other factors.

BRIEF DESCRIPTION OF THE INVENTION

An object of the invention is to provide a very exact process that makes it possible to operate the aluminum reduction at as low a temperature as possible, and therefore as energy-saving as possible.

This object is achieved according to the invention in that the liquidus temperature of the cryolite melt is measured, the measured liquidus temperature is compared to a first target value, and $AlF_3$ is added to the bath if the measured liquidus temperature is higher than the first target value. If the measured liquidus temperature is lower than the first target value, the measured liquidus temperature is compared with a second target value that is lower than the first target value, and NaF or $Na_2CO_3$ is added to the bath if the measured liquidus temperature is lower than the second target value.

Since the liquidus temperature of a melt allows very exact conclusions about the proportion of individual components of the melt, the process according to the invention offers the possibility of caring out the aluminum reduction process in as energy-favorable a manner as possible and thus as economically as possible. The invention also explicitly includes the reverse comparison between a target value and the measured value of the liquidus temperature, namely that the measured liquidus temperature is first compared with the second target value, and NaF or $Na_2CO_3$ is added to the bath if the measured liquidus temperature is lower than this second target value. If the measured liquidus temperature is higher than the second target value, the measured liquidus temperature is compared to the first target value, which is greater than the second target value, and $AlF_3$ is added to the bath if the measured liquidus temperature is higher than this first target value. If, for example, the measured liquidus temperature is lower than the second target value, a comparison with the first, higher target value is of course superfluous. If the measured liquidus temperature lies between the two target values, no addition of a component influencing the liquidus temperature occurs.

DETAILED DESCRIPTION OF THE INVENTION

Two different target values are necessary in order to create a buffer zone and to prevent overreactions, which can occur due to constant compensation additions.

The temperature difference between the two target values depends, among other things, on the stability of the aluminum reduction process. If the process is stable, a smaller temperature difference can be selected. The liquidus temperature of the bath is dependent on all components, in particular on $Al_2O_3$ and $AlF_3$. The difference between two target values is thus also a function of the way in which and the quantity and precision with which $AlF_3$ (or other components, such as $Al_2O_3$) is added. For example, the difference can be correspondingly smaller, the smaller the respectively supplied quantity. With a point dosing (point feeder), less but more precise dosing is used than with a middle feeder (center bar breaker) or a side feeder (sideworked cell). The difference between the first and the second target value is also dependent, among other things, on the experience of the operator who is controlling the melt, wherein it fundamentally applies that the difference can become smaller with increasing experience of the operator.

Fundamentally, the liquidus temperature of the melt can be lowered by the addition of $AlF_3$ and increased by the addition of NaF. For an increase, however, the addition of $Na_2CO_3$ is also possible, since $Na_2CO_3$ contributes to the formation of NaF in the melt and thus to the increase of the NaF portion and to the reduction of the $AlF_3$ portion. A liquidus temperature that is too high indicates an $AlF_3$ concentration that is too low, while a liquidus temperature that is too low indicates an $AlF_3$ concentration that is too high. By addition of NaF or $Na_2CO_3$, cryolite is formed together with $AlF_3$, and thus the $ATF_3$ concentration is lowered. Initially, a target value can be determined for a liquidus temperature from the known phase diagrams, taking into account the initial composition of the bath. The second target value is established for an assumed bath composition. The concrete relationships between the bath composition and the bath temperature are themselves described in detail in U.S.Pat. No. 4,668,350. In this regard, reference is made explicitly to this disclosure, and the patent is incorporated herein by reference.

According to the invention, it is advantageous that the cooling curve of a sample of the melt outside of the molten bath itself be measured, and the liquidus temperature thereby be determined. In principle, it is also of course possible to measure the liquidus temperature by other suitable processes that are sufficiently known to the artisan.

In the following, an embodiment of the process according to the invention is described.

The first target value can be calculated from the average or the current bath composition. For example, a bath with a proportion of 5% $CaF_2$ , 3% $Al_2O_3$, and with an excess of 12% $AlF_3$ (Halvor Kvande, *Journal of Metallurg*, pp. 22ff (November 1994)) has a liquidus temperature of 955° C. With an $AlF_3$ excess of 11% the liquidus temperature amounts to 960° -C, and with an $AlF_3$ excess of 13% the liquidus temperature amounts to 950° C. That is, a variation of the $AlF_3$ excess of 2% causes a change of the liquidus temperature by 10° C. Calculations of this type are described, for example, in Solheim et al., *Light Metals* 1995, The Minerals, Metals & Materials Society, pp. 451ff (1995). If the first target value amounts to 960° C., for example, and a liquidus temperature of 970° C. is measured, the $AlF_3$ excess is to be increased by about 2%.

With a stable bath the target temperature (target value) can be lowered. The $AlF_3$ concentration thereby increases, which leads to a higher current efficiency. If the bath cell becomes unstable, the liquidus temperature (target value) is to be increased. The cell stability can be monitored in a conventional manner by regular checks with a suitable sensor.

The second target value depends, among other things, on the type of the addition of $Al_2O_3$ to the bath. With an automatic or a point feeding the second target value can lie approximately 10° C. below the first target value, whereas with a center bar breaker and without automation of the addition the second target value can lie approximately 20° C. below the first target value. If the measured value of the liquidus temperature lies above the first target value, $AlF_3$ is added according to the aforementioned model composition. If the measured value of the liquidus temperature lies below the second target value, NaF (or $Na_2CO_3$) is added, such that an addition of 3% NaF (relative to the entire bath) leads to an increase of the liquidus temperature by approximately 10° C. If the second target value amounts to 950° C., and a liquidus temperature of 940° C. is measured, an addition of 3% NaF (or a corresponding quantity of $Na_2CO_3$), relative to the entire bath, is necessary.

The measurements can be performed, for example, every two days or daily.

It will be appreciated by those skilled in the art that changes could be made to the embodiment(s) described above without departing from the broad inventive concept thereof. It is understood, therefore, that this invention is not limited to the particular embodiment(s) disclosed, but is intended to cover modifications within the spirit and scope of the present invention as defined by the appended claims.

I claim:

1. A process for controlling the $AlF_3$ content in cryolite melts for aluminum reduction, comprising measuring the liquidus temperature of a cryolite melt, comparing the measured liquidus temperature with a first target value, adding $AlF_3$ to a molten bath of the cryolite melt if the measured liquidus temperature is higher than the first target value, comparing the measured liquidus temperature with a second target value which is lower than the first target value, and adding NaF or $Na_2CO_3$ to the molten bath of the cryolite melt if the measured liquidus temperature is lower than the second target value.

2. The process according to claim 1, wherein the liquidus temperature is determined by measuring the cooling curve of a sample of the cryolite melt outside of the molten bath of the cryolite melt.

* * * * *